United States Patent [19]

Sentoku

[11] Patent Number: 4,861,312

[45] Date of Patent: Aug. 29, 1989

[54] COIN HANDLING APPARATUS

[75] Inventor: Hideshi Sentoku, Tokyo, Japan

[73] Assignee: Laurel Bank Machine Co., Ltd., Tokyo, Japan

[21] Appl. No.: 170,379

[22] Filed: Mar. 18, 1988

[30] Foreign Application Priority Data

Mar. 19, 1987 [JP] Japan ..... 62-65348
Mar. 19, 1987 [JP] Japan ..... 62-65349

[51] Int. Cl.[4] ..... G07D 3/16
[52] U.S. Cl. ..... 453/7; 453/31
[58] Field of Search ..... 453/5, 6, 7, 9, 10, 453/11, 12, 14, 31, 59

[56] References Cited

U.S. PATENT DOCUMENTS

| | | | |
|---|---|---|---|
| 748,934 | 1/1904 | Doldt | 453/14 |
| 3,396,737 | 8/1968 | Picollo | 453/5 |
| 3,981,384 | 9/1976 | Kovar | 453/5 X |
| 4,123,892 | 11/1978 | Asami | 453/31 X |
| 4,178,502 | 11/1979 | Zimmermann | 453/9 X |

FOREIGN PATENT DOCUMENTS

| | | |
|---|---|---|
| 56-88380 | 7/1981 | Japan . |
| 59-84721 | 5/1984 | Japan . |
| 62-30141 | 2/1987 | Japan . |
| 62-65348 | 3/1987 | Japan . |

*Primary Examiner*—F. J. Bartuska
*Attorney, Agent, or Firm*—Fleit, Jacobson, Cohn, Price, Holman & Stern

[57] ABSTRACT

A coin handling apparatus comprising a coin introducing section for introducing various kinds of coins of various diameters into the apparatus, a discriminating section for discriminating the coins introduced into the apparatus and counting the number of the respective kinds of the coins, a large coin separating section for separating coins larger in diameter than a predetermined kind of coins among the discriminated coins and introducing the larger coins to a large coin container, a selecting section for excluding coins smaller in diameter than the coins of the predetermined kind of coins to pass to a small coin container whereby only the predetermined kind of coins remain, an accumulating section for accumulating one by one the predetermined kind of coins selected in the selecting section, and a wrapping section for wrapping a predetermined number of the accumulated coins. The apparatus removes both the larger and smaller coins than the predetermined kind of coins so that the coins introduced into the apparatus can be handled to be wrapped in any order of diameter.

11 Claims, 5 Drawing Sheets

COIN HANDLING APPARATUS

BACKGROUND OF THE INVENTION

1. Field of the Invention

The present invention relates to a coin handling apparatus, and more particularly to an apparatus for selecting a specified coin and wrapping a predetermined number of the coins.

2. Description of the Prior Art

In a coin handling apparatus, specifically in a coin wrapping apparatus, conventionally a predetermined kind of coin is selected from among a plurality of kinds of coins in response to the width of the coins to be wrapped by a wrapping sheet in the form of a stack of a predetermined number of coins. In order to select the predetermined kind of coin from among many kinds of coins, there is provided a guide passage, the width of which is adjustable so that coins smaller in diameter than the predetermined kind of coin drop out of the guide passage, and only the predetermined kind of coin is allowed to pass therethrough. Thus, coins other than the predetermined kind of coin are excluded from the path of the coins fed through the apparatus and only the predetermined kind of coin introduced into a wrapping section. Therefore, in the conventional coin handling apparatus, coins are counted and wrapped in the order of the diameter thereof, from the largest to the smallest. However, if coins with larger diameters than the predetermined kind of coins are introduced, the coin handling apparatus becomes inoperative because the guide passage cannot accept such larger coins. Therefore, the operator of the apparatus has had to memorize the order of the diameter of all kinds of coins to be handled. In this regard, Japanese Patent Public Disclosure No. 59-84721, which was laid-open to the public on May 16, 1984, discloses a coin counting and packaging apparatus provided with a mechanism for memorizing the order of the diameter of the coins to be counted and wrapped so as to handle the coins automatically in accordance with a command from the operator of the apparatus. It should be noted, however, that the apparatus as disclosed in the Japanese patent application is complicated in structure and therefore high in manufacturing cost.

The Japanese Utility Model Publication No. 62-30141 discloses a larger coin excluding mechanism of a coin handling apparatus, wherein coins larger in diameter than a predetermined kind of coin climb up to a slanted surface formed at one side of a curved coin handling path so that the larger coins are separated from other coins which are conveyed along the curved path. However, in order for this mechanism to accurately separate the larger coins, a longer curved coin handling path is needed, thereby requiring a larger apparatus. Moreover, it is difficult to control the width of the path because it is curved in the separating zone. As a result, it is likely to fail to separate the larger coins properly.

Further, the conventional coin handling apparatus is inconvenient in that the operator cannot calculate the amount of money being handled by the apparatus until all kinds of coins are wrapped.

SUMMARY OF THE INVENTION

It is therefore an object of the present invention to provide a coin handling apparatus which can wrap a plurality of kinds of coins in any order of diameter.

It is another object of the present invention to provide a coin handling apparatus which can separate both coins which are smaller and larger in diameter than a predetermined kind of coin from a coin handling path and wrap only the predetermined kind of coin.

It is a further object of the present invention to provide a coin handling apparatus which discriminates all kinds of coins being handled and calculates the total amount of money prior to a coin selecting operation and a coin wrapping operation.

It is still a further object of the present invention to provide a compact coin handling apparatus which can accurately select a predetermined kind of coin.

According to the present invention, the above objects can be accomplished by a coin handling apparatus comprising a coin introducing section for introducing various kinds of coins of various diameters into the apparatus, a discriminating section for discriminating the coins introduced into the apparatus and counting the number of the respective kinds of the coins, a large coin separating section for separating coins larger in diameter than a predetermined kind of coin among the discriminated coins and passing the larger coins to a large coin container, a selecting section for excluding coins smaller in diameter than the predetermined kind of coin and passing them to a small coin container whereby only the predetermined kind of coin remain, and accumulating section for accumulating one by one the predetermined kind of coin selected in the selecting section, and a wrapping section for wrapping a predetermined number of the accumulated coins.

According to the features of this invention, a plurality of kinds of coins are introduced into the coin handling apparatus. The respective kinds of coins introduced into the apparatus are discriminated based on the material, size and the like by means of sensors so that the number of the respective kinds of coins, and therefore the total amount of money introduced into the apparatus, can be calculated before the coins are subjected to any sorting operation. Thereafter, large diameter coins are separated at the separating section to be introduced into a large coin container. In the separating section, the larger coins climb up an inclined surface gradually ascending in the downstream direction of the path, which surface is formed at one side of the path so that the larger coins are conveyed in an inclined position straight into a container. On the other hand, small diameter coins move along the path, which curves at the downstream portion thereof toward the selecting section, in a manner that the ends of the coins are brought into contact with an arcuate leading side surface of the path. The remaining coins are introduced into the selecting section where coins smaller in diameter than the predetermined coins drop out of a conveyance path of an adjusted width to be removed from the handling line so that only a predetermined kind of coin is fed to the accumulating section and thereafter to the wrapping section.

The above and other objects of the present invention will be apparent from the following descriptions of the preferred embodiments, taken in conjunction with the accompanying drawings.

DESCRIPTION OF THE PREFERRED EMBODIMENTS

Figure 1:
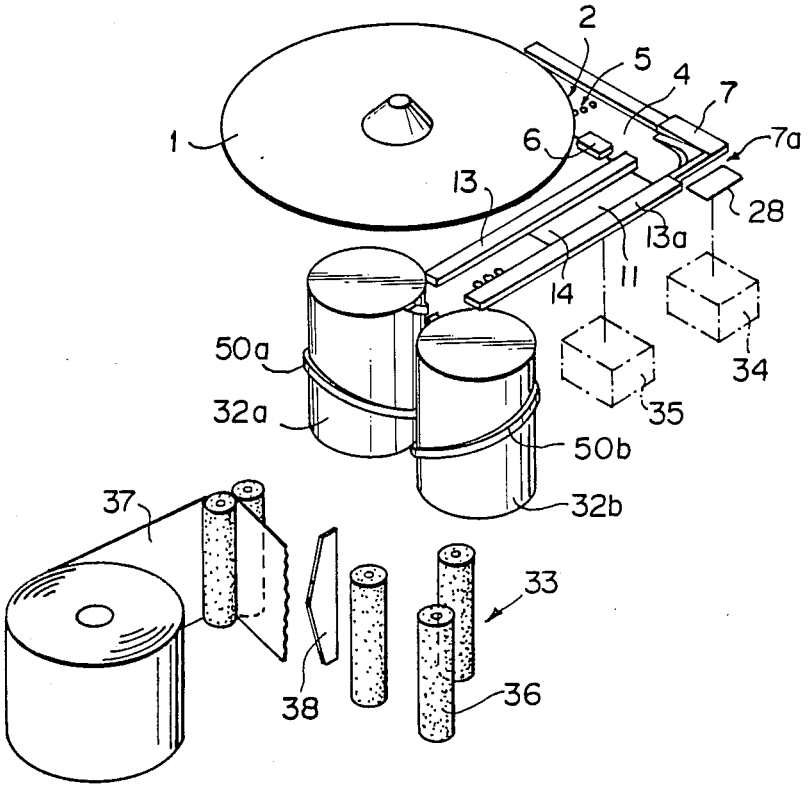
FIG. 1 is a schematic perspective view of a coin handling apparatus in accordance with the present invention.

Referring to the drawings, particularly to FIG. 1, there is shown a coin handling apparatus comprising a coin introducing section 2 including a rotary disc 1 for introducing coins fed thereto to a peripheral portion thereof. The apparatus is provided downward of the disc 1 with a coin passage member 4 for constituting a coin conveying path in which all the coins from the disc 1 are conveyed downstream by means of a conveyor belt 3 one by one through a discriminating section 5 provided halfway along the passage member 4.

The discriminating section 5 is comprised of a material discriminating section 5*a* for discriminating the material of the coins fed thereto and a diameter discriminating section 5*b* for detecting the diameter of the coins whereby the kind of the coin is discriminated. The material discriminated section 5*a* is usually provided with a detecting coil device for detecting a change in the magnitude of a magnetic flux thereof when a coin passes through the magnetic field thereof. The diameter discriminating section 5*b* is usually provided with photo array image sensors for detecting the amount of light interrupted by each coin. Signals from the coil device and the image sensors are transmitted to a control unit (not shown), which compares the signals with given data stored therein to determine the kind of the coin. In the discriminating section 5, the coins fed thereto are counted by kind so that the total amount of the money can be calculated.

Figure 2:
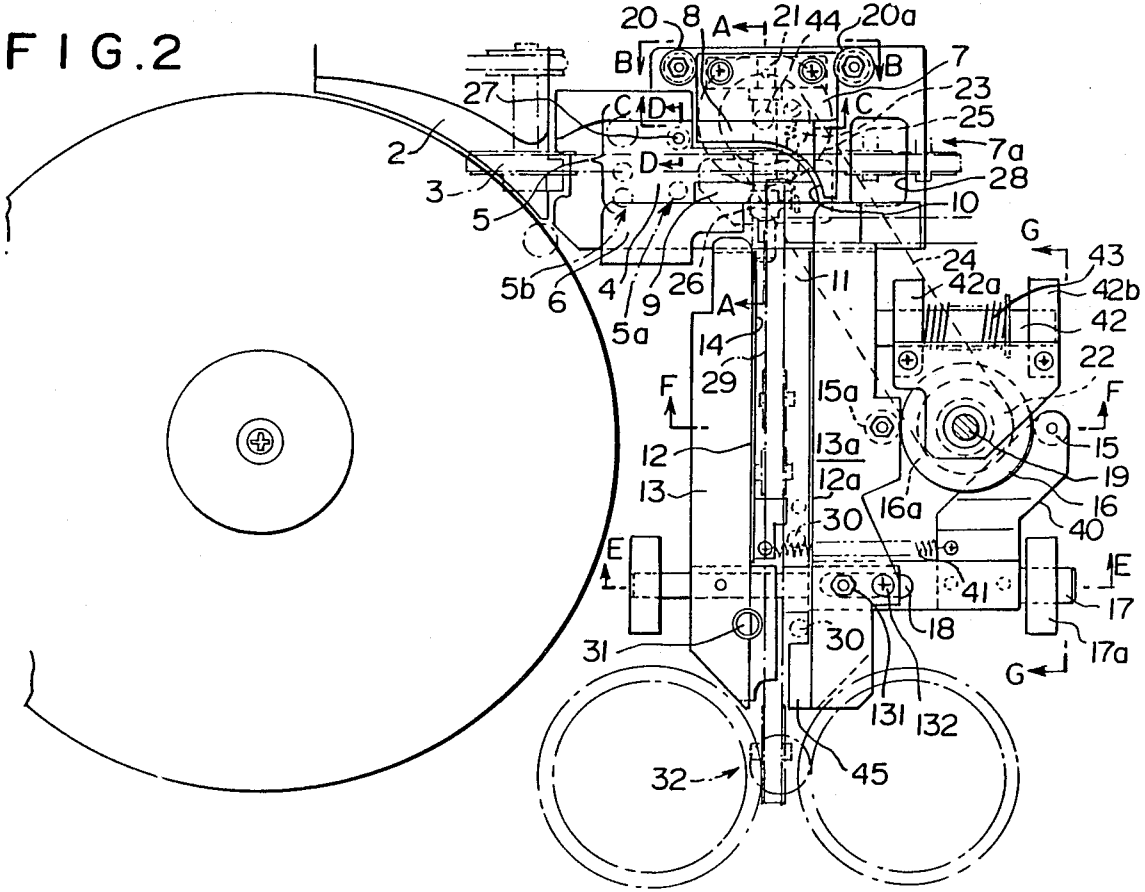
FIG. 2 is a plan view of the coin handling apparatus shown in FIG. 1.

As shown in FIG. 2, there are disposed a guide plate 6 and a separating guide member 7 at the downstream portion of the passage member 4. The separating guide member 7 can be moved to adjust the distance between the guide plate 6 and guide member 7.

Figure 3:
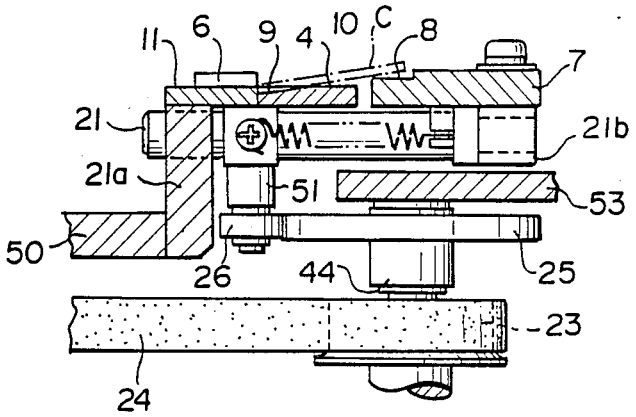
FIG. 3 is a sectional view taken along line A—A in FIG. 2.
Figure 4:
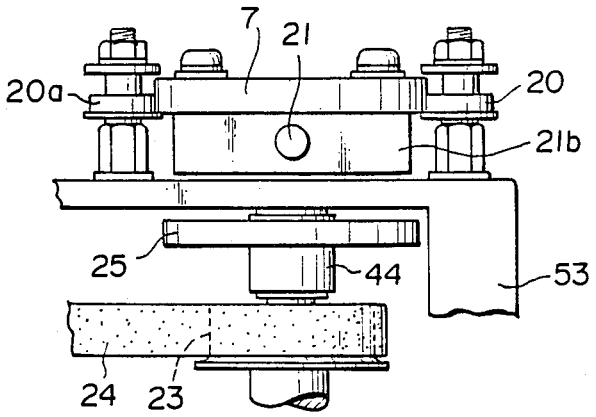
FIG. 4 is a sectional view taken along line B—B in FIG. 2.
Figure 5:
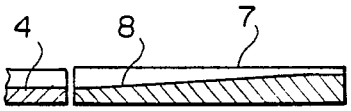
FIG. 5 is a sectional view taken along line C—C in FIG. 2.

Referring to FIGS. 3 and 5, the separating guide member 7 is provided with an inclined surface 8 which ascends gradually from the level of the bottom surface of the passage member 4 in the downstream direction of the conveying line. The passage member 4 is formed with an inclined surface 9 which declines gradually toward the guide plate in the traverse direction of the conveying line so as to form a recess. The guide member 7 is formed with a lead wall 10, which extends vertically from one side end of the inclined surface 9.

Figure 7:
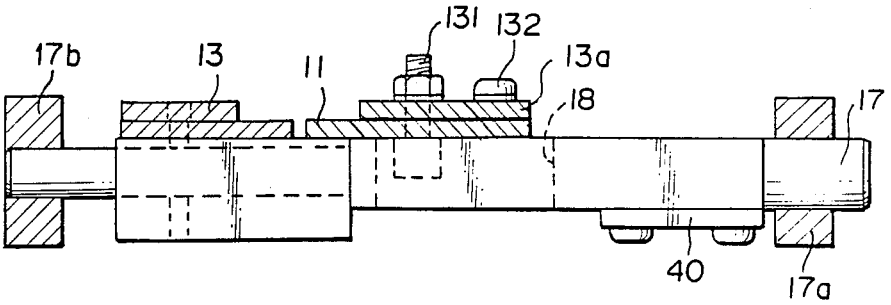
FIG. 7 is a sectional view taken along line E—E in FIG. 2.
Figure 8:
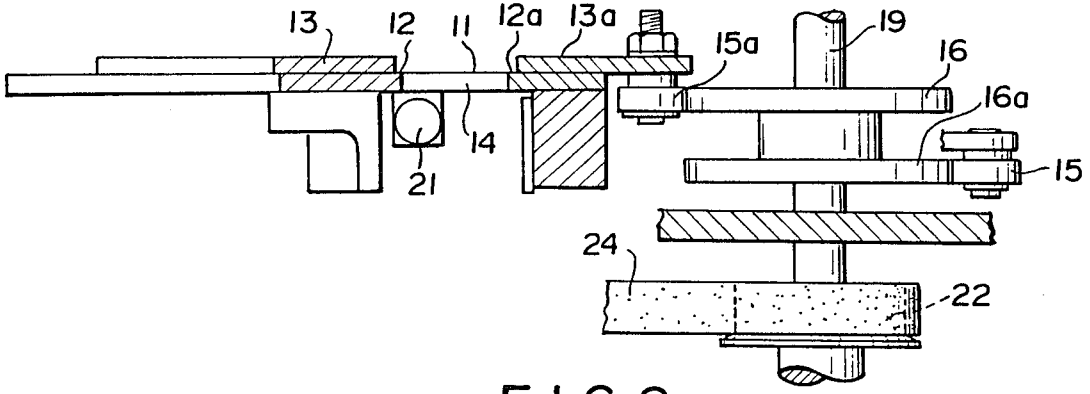
FIG 8. is a sectional view taken along line F—F in FIG. 2.

The lead wall 10 is adapted to contact coins to deflect them toward a selecting section all coins fed to the conveying line that are larger in diameter than a predetermined kind of coin so as to remove them from the conveying line. It will be understood that the inclined surface 8 of the passage member 4, guide plate 6, and the inclined surface 9 and the lead wall 10 of the guide member 7 constitute a larger coin separating section 7*a*. The selecting section 11 is arranged at a right angle to the larger coin separating section 7*a* downstream thereof with regard to the coin conveying line. The selecting section 11 is provided with selecting guides 13, 13*a* having rails 12, 12*a* respectively. There is formed a groove 14 between the guides 13, 13*a*. The selecting guide 13 is fixed to a supporting rod 17 which is slidably mounted on a base member 50 through brackets 17*a*, 17*b* at the opposite ends in the longitudinal direction thereof; that is, in the traverse direction of the conveyer line, as shown in FIG. 7. On the supporting rod 17 is also mounted a support 40 of a cam follower 15 which is urged against an adjusting cam 16*a* for adjusting the width of the space between the guides 13, 13*a* by means of a coil spring 41. The guide 13*a* is provided at one end portion with projections 131 and 132 which are received in an elongated opening 18 formed on the rod 17 so that the guide 13*a* is engaged with the rod 17 and carried thereby.

Figure 9:
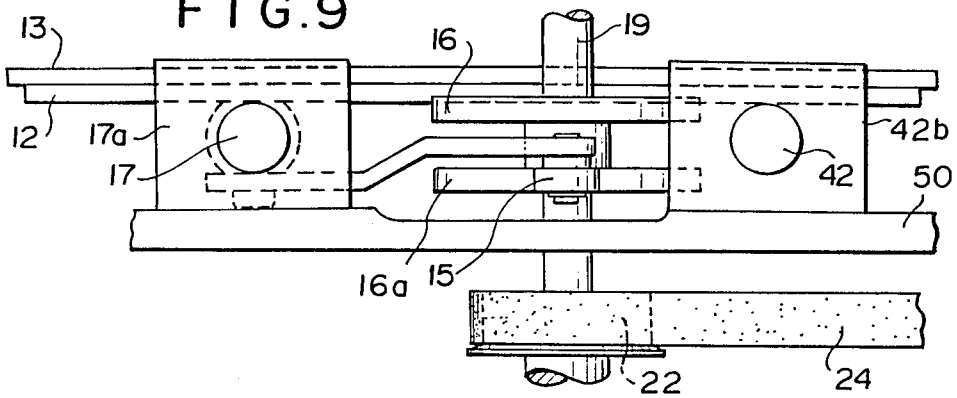
FIG. 9 is a sectional view taken along line G—G in FIG. 2.

Now referring to FIGS. 2 and 9, the guide 13*a* is connected at the other end to a supporting rod 42 which is slidably mounted on the base member 50 through brackets 42*a* and 42*b* in the longitudinal direction of the rod 42; that is, in the traverse direction of the conveyer line. The guide 13*a* is provided with a cam follower 15*a*. The rod 42 is engaged with a coil spring 43 so that the cam follower 15*a* of the guide 13*a* is urged against the cam 16, as shown in FIG. 2.

The cam faces the cams 16, 16*a* are formed depending on the diameter of the predetermined kind of coins so that the guides 13, 13*a* can be moved symmetrically to each other in the traverse direction of the conveying line by controlling an adjusting shaft 19.

The separating guide member 7 is mounted between guide rollers 20, 20*a* on a supporting rod 21 and is brought into engagement with the rollers 20, 20*a* to restrict movement of the guide member 7 to correspond with the rod 21 in the longitudinal direction of the rod 21. The rod 21 is slidably engaged with brackets 21*a* and 21*b*, the bracket 21*a* being fixed to the base member 50. The rod 21 is provided with a projection 51 extended downwardly. The projection 51 is provided with a cam follower 26 which is brought into engagement with an adjusting cam 25. The cam 25 is mounted on a cam shaft 44 which is carried for rotation by a base member 53. The shaft 44 is provided with a pulley 23 which is engaged through a belt 24 with a pulley 22 mounted on the shaft 19, as shown in FIGS. 2 and 3. Thus, when the cam shaft 44 is rotated by the belt 24, the supporting rod moves in the longitudinal direction so that the guide member 7 is moved to adjust the distance between the guide plate 6 and the member 7.

As mentioned above, it will be understood that the positions of guide member 7 and the guides 13, 13*a* can be controlled merely by rotation of the adjusting shaft 19.

There is provided an accumulating section 32 downstream of the selecting section 11. In the accumulating section 32, the predetermined kind of coins drop from the downstream end 45 of the selecting section 11 to be accumulated one by one. The accumulating section 32 includes a pair of rotating drums 32*a*, 32*b* which are provided with helical shelves 50*a*, 50*b* formed on the external surface thereof. The drums 32*a* and 32*b* are rotatably driven by a stepping motor (not shown). As the stepping motor is driven, the drums 32*a* and 32*b* are rotated in opposite directions so that the predetermined kind of coins are accumulated between the shelves 50*a* and 50*b*.

When the number of the coins reaches the predetermined amount to form a stack of coins of predetermined height, the coin stack is introduced into a wrapping section 33 by means of a supporting rod (not shown) and wrapped by a wrapping sheet 37 by employing a wrapping roller 36.

Figure 6:
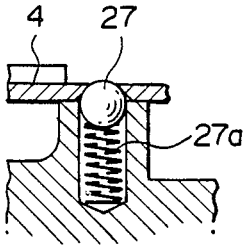
FIG. 6 is a sectional view taken along line D—D in FIG. 2.

In operation, all the coins fed into the disc 1 are moved to the peripheral portion of the disc 1 by centrifugal force as the disc 1 rotates. Thereafter, the coins are fed downward on the conveyor belt 3 and passed onto the passage member 4. On the passage member 4, passing through the discriminating section 5, the coins are discriminated with regard to the materials and diameters and thereafter counted as mentioned above. Coin C, having a larger diameter than the predetermined kind of coin, climbs up on the inclined surface 8 of the guide member 7 at one end thereof, as shown in FIG. 3. The other end of the coin C is received in the recess 9 so that the coin C is moved in an inclined state on the conveyer line. In order to facilitate the climb of coin C up the inclined surface 8, there can be provided a ball which is urged by a spring 27*a* so as to project from the surface of the passage member 4, as shown in FIG. 6. The coin C is carried by the conveyor belt 3 to move straight and away from the conveying line of the smaller coins which are brought into engagement with the lead wall 10 so that the coin C of the larger diameter is introduced into an opening for separating coins of larger diameters and thereafter deposited in a coin box 34.

The predetermined kind of coins and coins having a smaller diameter pass through the passage member 4 and are brought into contact with the lead wall 10 formed as a stepped portion by the inclined surface 8. Then the coins of the smaller diameter move along the arcuate lead wall 10 so as to be deflected toward the selecting section 11. It should be noted that the arcuate lead wall 10 is disposed at the downstream portion of the guide member and therefore that at the entrance of the larger coin separating section 7*a*, all the coins keep straight on but only the larger diameter coins climb up to the inclined surface 8 to be separated from the others.

Thereafter, the remaining coins or the coins other than the larger diameter coins are introduced into the selecting section 11 by means of the conveyor belt 29. In the selecting section 11, the predetermined kind of coins are conveyed on the rails 12, 12*a*, but coins having a smaller diameter than the predetermined kind of coins drop from the separating passage or groove 14 formed by the rails 12, 12*a* to be deposited into a coin box 35 for the smaller coins.

Thus, only the predetermined kind of coins are conveyed to reach the downstream end of the rails 12, 12*a*. In the vicinity of the end portion of the rails 12, 12*a*, there is provided a detecting section including various sensors for discriminating damaged coins, for detecting coins other than the predetermined kind of coins by comparing them with the data from the discriminating section 5, and for counting the number of the predetermined kind of coins.

A stopper 31 is adapted to limit the stream of the coins from a discharging end 45 of the rails 12, 12*a* to the accumulating section 32 when the number of the predetermined kind of coins introduced into the accumulating section 32 reaches a predetermined value.

In the accumulating section, the coins discharged from the rails 12, 12*a* are accumulated one by one. When the number of the accumulated coins reaches the predetermined value for a coin stack, the coin stack is moved to the wrapping section 33 where it is wrapped by a wrapping sheet 37. The cutter 38 is applied to the wrapping sheet 37 to cut the wrapped coin stack. Thereafter, the wrapping sheet 37 around the coin stack is caulked by a caulking pawl at the opposite ends.

Although the larger and smaller coins than the predetermined kind of coins are stored in respective containers 34, 35 in the illustrated embodiment, it should be noted that the larger and smaller coins can be stored in a single container.

Thus, according to the present invention, various kinds or sizes of coins can be handled to be wrapped in any order because the coin handling apparatus can remove both larger and smaller kinds of coins than a predetermined kind of coin. Further, the total amount of coins fed into the apparatus can be calculated prior to the selecting and wrapping operations.

The invention has thus been shown and described with reference to specific embodiments. However, it should be noted that the invention is not limited to the details of the illustrated structures, but changes and modifications may be made without departing from the scope of the appended claims.

What is claimed is:

1. A coin sorting device for a coin handling apparatus, said coin sorting device comprising a rotatable disc to which various kinds of coins of various diameters are introduced and which feeds the coins one by one into the inside of the device by a centrifugal force, a discriminating section for discriminating the coins from said rotatable disc and for counting the number of the respective denominations of coins, a large coin separating path having a guide member for separating coins larger in diameter than a predetermined denomination of coins among the coins introduced from said rotatable disc via said discriminating section, conveyor belt means for conveying coins introduced from said rotatable disc along said large coin separating path, a selecting path having rail members and at least one groove for excluding coins smaller in diameter than the predetermined denomination of coins by dropping coins smaller in diameter than the predetermined denomination of coins through said at least one groove whereby only the predetermined denomination of coins remain and said guide member being provided with an inclined surface onto which the coins of larger diameter climb up and an arcuate lead wall for leading coins other than the coins of larger diameter to said selecting path.

2. A coin sorting device for a coin handling apparatus in accordance with claim 1 in which the guide member of the large coin separating path and the rail members can be adjusted to change the widths of the paths respectively in accordance with a size of the predetermined kind of coins, and the guide member and the rail members being adapted to be associated with each other by means of a transmitting means for transmitting a drive force.

3. A coin sorting device for a coin handling apparatus in accordance with claim 1 in which the large coin separating path is provided with ball means for facilitating the coins of larger diameter to climb up to the inclined surface.

4. A coin sorting device for a coin handling apparatus in accordance with claim 1, in which said large coin separating path extends in a direction substantially perpendicular to a direction in which said selecting path extends.

5. A coin sorting device for a coin handling apparatus in accordance with claim 1, in which said large coin separating path extends in a same direction as a direction in which the coins are introduced from said rotatable disc.

6. A coin handling apparatus comprising a rotatable disc onto which various kinds of coins of various diameters are introduced and which feeds the coins one by one into the inside of the device by a centrifugal force, a discriminating section for discriminating the coins fed from said rotatable disc and counting the number of the respective denominations of coins, a large coin separating path having a guide member for separating coins larger in diameter than a predetermined denomination of coin from among the coins introduced from said rotatable disc via said discriminating section, conveyor belt means for conveying coins introduced from said rotatable disc along said large coin separating path and conveying the larger coins separated by said large coin separating path to a larger coin container, a selecting path having rail members and at least one groove for excluding coins smaller in diameter than the predetermined denomination of coin by dropping coins smaller in diameter than the predetermined denomination of coin through said groove and passing the coins smaller in diameter than the predetermined denomination of coin to a smaller coin container whereby only the predetermined denomination of coins remain, said guide member being provided with an inclined surface onto which the coins of larger diameter climb up and an arcuate lead wall for leading coins other than the coins of larger diameter to said selecting path, an accumulating section for accumulating one by one the predetermined denomination of coins selected in said selecting section, and a wrapping section for wrapping a predetermined number of the accumulated coins.

7. A coin handling apparatus in accordance with claim 6, in which said large coin separating path extends in a direction substantially perpendicular to a direction in which said selecting path extends.

8. A coin handling apparatus in accordance with claim 6, in which said large coin separating path extends in a same direction as a direction in which the coins are introduced from said rotatable disc.

9. A coin handling apparatus in accordance with claim 6, in which said large coin separating path and said selecting path are respectively provided with adjustable passage means, the width of said passage means being adjustable in accordance with the size of the predetermined coins, one of the adjustable passage means being adapted to be associated with other adjustable passage means by means of a transmitting means for transmitting a drive force so that the width of one of said passage means is changed to correspond with the change in the width of the other passage means when the width of the other passage means is controlled for the predetermined denomination of coins.

10. A coin handling apparatus in accordance with claim 9, in which said large coin separating path is provided with ball means for facilitating coins of larger diameter to be separated from others.

11. A coin handling apparatus comprising a rotatable disc to which various kinds of coins of various diameters are introduced and which feeds the coins one by one into the inside of the device by a centrifugal force, a discriminating section for discriminating the coins fed from said rotatable disc and counting the number of the respective denominations of coins, a large coin separating path having a guide member for separating coins larger in diameter than a predetermined denomination of coin among the coins introduced from said rotatable disc via said discriminating section, conveyer belt means for conveying coins introduced from said rotatable disc along said large coin separating path and conveying the larger coins separated by said large coin separating path to a coin container, a selecting path having rail members and at least one groove for excluding coins smaller in diameter than the predetermined denomination of coins by dropping coins smaller in diameter than the predetermined denomination of coin through said groove and passing coins smaller in diameter than the predetermined denomination of coin to said coin container whereby only the predetermined kind of coins remain, said guide member being provided with an inclined surface onto which the coins of larger diameter climb up and an arcuate lead wall for leading coins other than the coins of larger diameter to said selecting path, an accumulating section for accumulating one by one the predetermined denomination of coins selected in said selecting section, and a wrapping section for wrapping a predetermined number of the accumulated coins.

* * * * *